FIP8011 OR 3,951,209

United States Patent [19]

Gibbs

[11] 3,951,209

[45] Apr. 20, 1976

[54] METHOD FOR DETERMINING THE PUMP-OFF OF A WELL

[75] Inventor: Sam G. Gibbs, Midland, Tex.

[73] Assignee: Shell Oil Company, Houston, Tex.

[22] Filed: June 9, 1975

[21] Appl. No.: 584,787

[52] U.S. Cl. ..... 166/250; 73/151; 166/314

[51] Int. Cl.[2] ..... E21B 47/00

[58] Field of Search ..... 166/250, 66, 314, 75; 73/151, 141 R, 141 A

[56] References Cited

UNITED STATES PATENTS

| | | | |
|---|---|---|---|
| 2,596,361 | 5/1952 | Blancher | 73/151 X |
| 2,677,272 | 5/1954 | Blancher | 73/151 X |
| 2,845,125 | 7/1958 | Truman | 166/250 X |
| 3,343,409 | 9/1967 | Gibbs | 73/151 |
| 3,359,791 | 12/1967 | Pantages | 73/151 |
| 3,457,781 | 7/1969 | Elliott | 73/151 |
| 3,527,094 | 9/1970 | Yew et al. | 73/141 A |
| 3,765,234 | 10/1973 | Sievert | 73/151 X |
| 3,817,094 | 6/1974 | Montgomery et al. | 73/151 |
| 3,824,851 | 7/1974 | Hagar et al. | 73/151 |
| 3,838,597 | 10/1974 | Montgomery et al. | 73/151 |

*Primary Examiner*—Stephen J. Novosad

[57] ABSTRACT

A method for monitoring a rod pumped well and determining when the well has pumped off. The method uses a dynamometer to monitor the power input to the rod string and senses when the power input decreases to determine when the well pumps-off.

4 Claims, 4 Drawing Figures

METHOD FOR DETERMINING THE PUMP-OFF OF A WELL

BACKGROUND OF THE INVENTION

The present invention relates to oil wells and particularly wells that are produced by beam pumping units. Wells that are produced by beam pumping units are commonly referred to as rod pumped wells to distinguish them from wells employing gas-lift or hydraulic pumps to produce the crude oil. In rod pumped wells, it is desirable to shut down the pumping unit when the well has pumped-off and allow the well to recover before restarting the pump. A well is said to be pumped-off when the downhole pump capacity significantly exceeds the volume of fluid available in the wellbore. In this case, the pump barrel does not completely fill with liquid on the up stroke and on the subsequent down stroke, the pump load is not released until the plunger encounters fluid in the barrel. At this point the load is suddenly released which causes pounding that can damage subsurface and surface equipment. Thus, it is desirable to sense when the well pumps-off so that it can be shut in until the additional fluid accumulates. This also results in a power saving and more efficient production.

The simplest way to accomplish this is to periodically test the well and then set the pumping unit on an appropriate duty cycle of on and off periods. If all well conditions remained unchanged, this method would be satisfactory, but well conditions change. Other methods have been suggested in the past such as sensing the electrical power input to electric motors that are used to drive some of the pumping units. When the electrical power decreases, the well is assumed to be pumped-off and the pumping unit is stopped. This approach has the major disadvantage of not measuring the actual power input to the downhole pump. Further, this approach cannot be used on pumping units utilizing internal combustion engines as their prime movers.

Recently, as illustrated by U.S. Pat. Nos. 3,817,094; 3,824,851 and 3,838,597 there has been a renewed interest in utilizing other methods of determining when a well is pumped-off. These patents all utilize some means such as a strain gage for measuring the strain in the beam of the pump and then utilizing the time derivative of this signal to determine when the well is pumped-off.

In the present inventor's previous U.S. Pat. No. 3,343,409 there is disclosed and described a method for determining the performance of a rod pumped well. The method disclosed utilizes a load transducer for measuring the load on the sucker rod in combination with a displacement transducer for measuring the displacement of the rod. Utilizing these two measurements, it is possible to calculate by means of conventional wave theory the actual performance of the downhole pump. The present invention utilizes the same type of measurements to provide a unique method for determining when the well is pumped-off.

BRIEF SUMMARY OF THE INVENTION

The present invention solves the above problems by utilizing the load transducer and displacement transducer measuring means of the above-referenced U.S. Pat. No. 3,343,409 to provide a unique method for determining when the well is pumped-off. More particularly, these measurements are integrated numerically to provide a measurement of the actual power input to the rod at the surface of the well during one stroke. In conventional well testing, force versus the displacement is plotted to provide what is conventionally referred to as a surface card for determining the actual performance of the downhole pump. The area of the surface card represents the actual power input to the rod string at the surface and this can be determined by integrating the load-displacement data. The point at which the well has pumped-off can be determined by a reduction in the power input to the rod string at the surface because the power required at the downhole pump decreases when the well pumps off.

The invention also utilizes the pumped-off signal for controlling the starting and stopping of the prime mover of the pumping unit. In particular, the point at which the well is pumped-off can be used to stop the prime mover, while the prime mover can be started a predetermined or preset time later. In particular, the preset time can be determined by utilizing the time required between the starting of the prime mover and the pumping-off of the well in the previous cycle. Thus, the method will continually vary the duty cycle of the pump and maximize production from the well while using a minimum of energy.

BRIEF DESCRIPTION OF THE DRAWINGS

The present invention will be more easily understood from the following detailed description of preferred embodiment when taken in conjunction with the attached drawings in which.

PREFERRED EMBODIMENT

Figure 1:
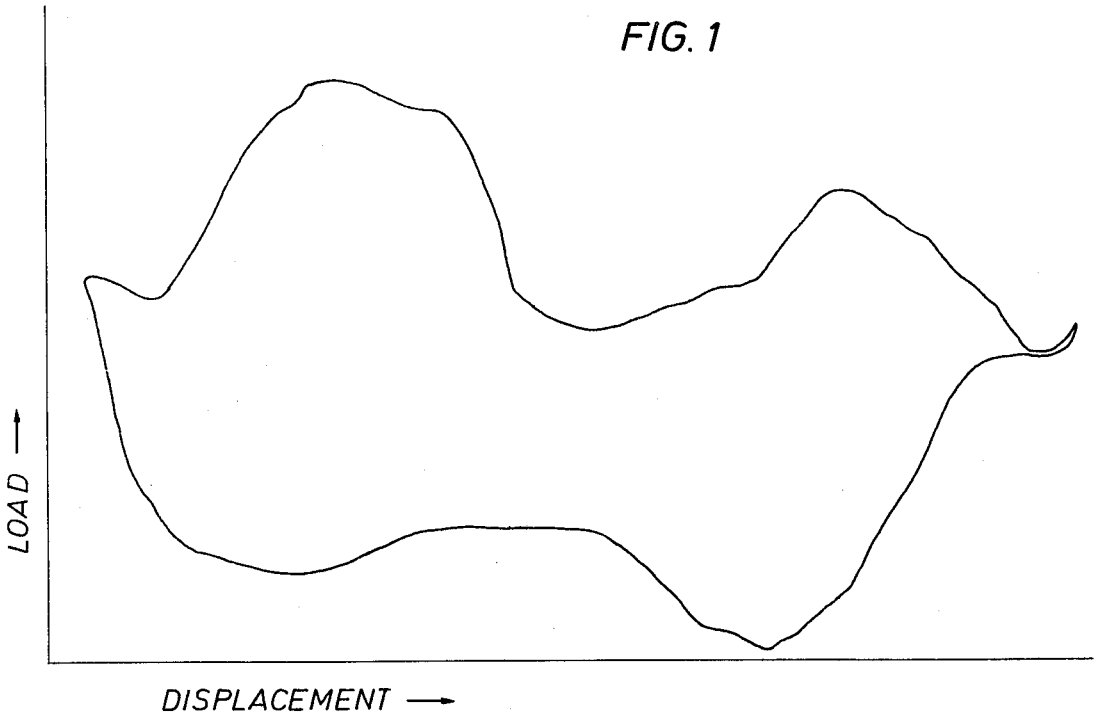
FIG. 1 illustrates a surface dynamometer card for a well producing at a maximum rate.
Figure 2:
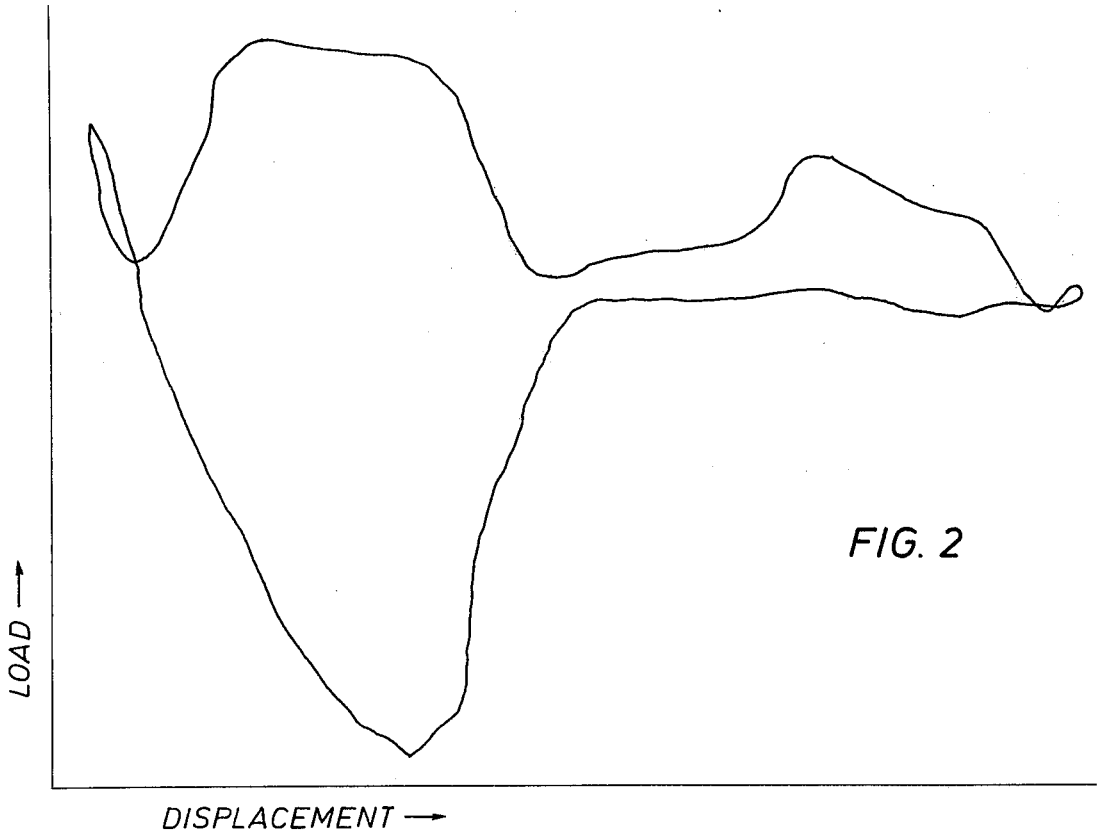
FIG. 2 illustrates a surface dynamometer card for the same well after it has pumped-off.

Referring now to FIGS. 1 and 2 there are illustrated dynamometer cards from the same well and drawn to the same scale to illustrate a maximum pumping condition in FIG. 1 and a pumped-off condition in FIG. 2. While the actual load on the rod string at a particular instance in the pumped-off condition may exceed the maximum load that occurs during routine pumping, the total area (a measure of input power) of the dynamometer card of FIG. 2 is approximately 25% less than the card of FIG. 1. In fact, the card of FIG. 1 illustrates approximately 20.5 horsepower while the card of FIG. 2 illustrates 17.1 horsepower. This is how pump-off is sensed using load and displacement data.

Figure 3:
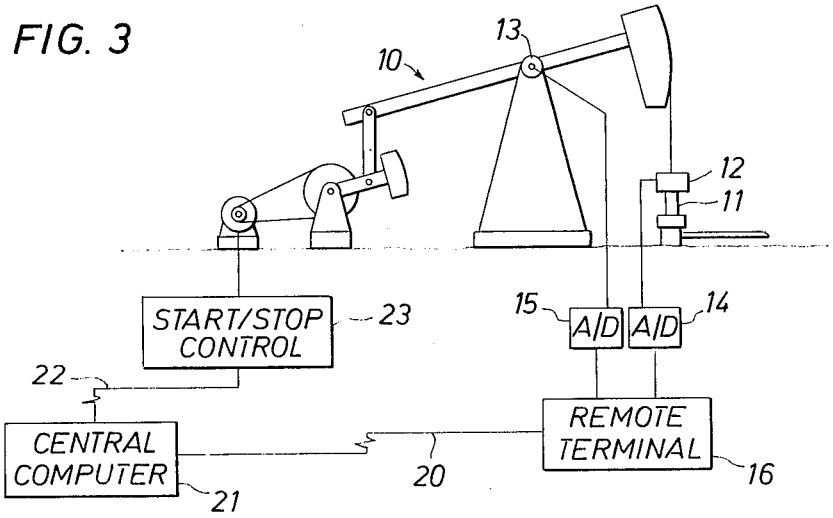
FIG. 3 illustrates in block diagram form a suitable system for controlling the starting and stopping of the pumping unit in response to the measured power input to the rod string.

The present invention utilizes a similar system to that disclosed in U.S. Pat. No. 3,343,409 to obtain measurements from which one can compute the area of the dynamometer card. In particular, in FIG. 3 there is illustrated a beam pumping unit 10 which is used to reciprocate the rod string 11 and actuate the downhole pump not shown in FIG. 3. This is all conventional oil field equipment and will not be described further. The actual load on the rod string is measured by a load cell 12 while the displacement of the rod string is measured by a beam angle transducer 13. The signals from the load cell 12 and the beam angle transducer 13 are supplied to analog-to-digital converters 14 and 15 for conversion to digital signals. Digital signals are supplied to remote terminal unit 16 which then transmits the signals over a line 20 to a central computer 21. The remote terminal 16 is designed to respond to command signals from the computer to sense the particular rod load and beam angle on designated wells. This type of terminal unit is manufactured by various companies, for example, TRW Data Systems of 3737 Westheimer Road, Houston, Tex.. A company supplying remote terminal units will supply them to perform any functions designated by the party purchasing them. The central computer 21 is programmed as outlined in the above patent to compute the actual area of the dynamometer card at the surface of the well. While the patent is directed to determining the actual operating condition of the downhole pump, it also contains instructions for computing the area of a dynamometer card. The area of the dynamometer card which is a measure of the input power to the well can be computed from the following formula:

Input Power for well $= C_i$ $$\sum_{k=1}^{\bar{k}}$$

$({}_iF_x + {}_iF_{k-1})({}_iA_{k-1} - {}_iA_k)$. In the above equation, the coefficient $C_i$ involves pumping speed and scale factors for the well mounted transducers and can be easily computed. Other numerical and analog methods can also be used to compute input power. The remaining elements of the equation are merely a summation of the force times the displacement which, of course, equals area or horsepower.

The central computer can also be programmed to perform various functions in addition to monitoring the wells for a pumped-off condition. For example, the computer memory can be provided with minimum settings for the horsepower input to each well being monitored. Thus, when the actual horsepower input to the top of the rod string falls below the minimum, the computer can produce a command which can be transmitted to the well to stop the pumping unit. For example, the command may be transmitted over a circuit 22 to a start/stop control 23 which stops the prime mover of the pumping unit. In the case of electrically driven pumping units, this can be a simple start/stop motor controller while, of course, internal combustion engines would require more complicated controls for automatically starting and stopping the prime mover. The computer can also be programmed to respond to malfunctions such as excessive loads on the rod strings or exceedingly small loads. Both of these conditions indicate malfunctioning of the downhole pump or a broken rod string. In either case, it is desirable to shut down the pumping unit.

Additional operations may also be performed by the computer to maximize the production from the formation. This may be accomplished by initially setting time periods during which the various wells are to be shut-in. As each of the wells are sampled and indicate a pumped-off condition and are stopped, the computer will then wait until the time period for that well has elapsed at which time it will restart the pumping unit. It is then possible to obtain a new off-time required for the well to accumulate fluid in the well bore. By comparing the time required to pump-off the well with the previous off-time, the computer can decide whether a longer or shorter shut-in period is desirable. If the shut-in period is too long, the well production may drop since the drainage from the formation will be opposed by the fluid accumulating in the borehole. Conversely, too short a shut-in period may require an excess power consumption for too frequent starting of the pumping unit. The computer can be easily programmed to optimize the shut-in periods.

Figure 4:
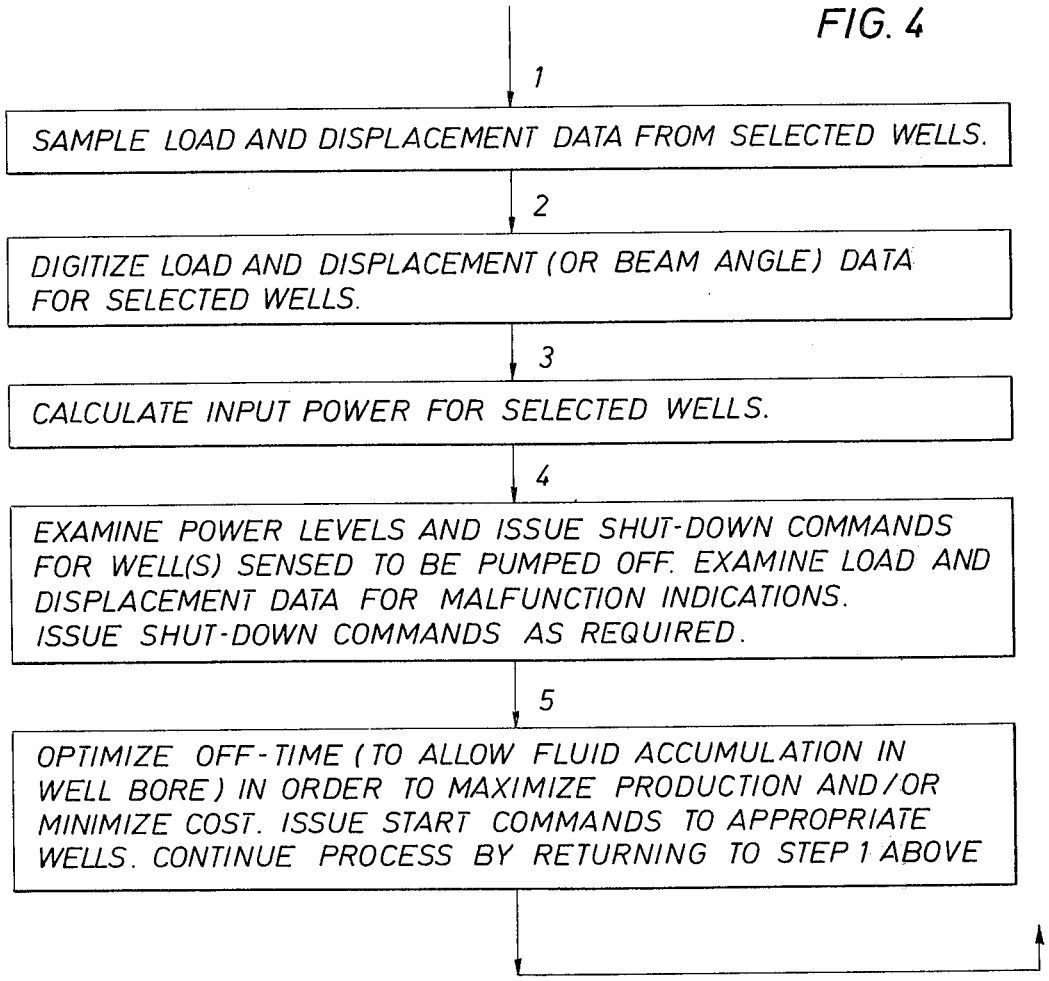
FIG. 4 is a simplified flow diagram of the process.

FIG. 4 illustrates a simple flow diagram for programming a computer to perform the above functions. One skilled in the art of programming can easily program a computer to carry out the commands set forth in FIG. 4.

I claim as my invention:

1. A method for monitoring a rod pumped well to determine when the well pumps-off comprising:

measuring the load on the rod;

measuring the displacement of the rod in a manner correlatible with the measurement of the load on the rod;

integrating measured load versus displacement to obtain the total power input to the well; and detecting when the total power falls below a predetermined minimum to determine when the well has pumped-off.

2. The method of claim 1 wherein said rod displacement is indirectly determined by measuring the angle of the pump beam.

3. The method of claim 1 and in addition stopping the pumping unit when it has been determined that the well has pumped-off.

4. The method of claim 3 and in addition starting the pump a preset time after it is stopped in order to maximize production while minimizing cost.

* * * * *

UNITED STATES PATENT OFFICE

CERTIFICATE OF CORRECTION

PATENT NO. 3,951,209

DATED : April 20, 1976

INVENTOR(S) : SAM G. GIBBS

It is certified that error appears in the above-identified patent and that said Letters Patent are hereby corrected as shown below:

Column 3, lines 21-27, the formula should appear as follows:

$$\text{Input Power for well} = C_i \sum_{k=1}^{\bar{k}} ({}_iF_x + {}_iF_{k+1})({}_iA_{k+1} - {}_iA_k).$$

Signed and Sealed this

Sixteenth Day of November 1976

[SEAL]

*Attest:*

RUTH C. MASON
*Attesting Officer*

C. MARSHALL DANN
*Commissioner of Patents and Trademarks*